US007603811B2

(12) United States Patent
Renke

(10) Patent No.: US 7,603,811 B2
(45) Date of Patent: Oct. 20, 2009

(54) LINEAR MOTOR-ACTUATED AUTOMOTIVE POWER WINDOWS

(75) Inventor: David T. Renke, Macomb, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 526 days.

(21) Appl. No.: 11/383,311

(22) Filed: May 15, 2006

(65) Prior Publication Data

US 2007/0261311 A1 Nov. 15, 2007

(51) Int. Cl.
*E05F 15/16* (2006.01)

(52) U.S. Cl. ..... 49/349; 49/360

(58) Field of Classification Search ..... 49/348, 49/349, 360, 502
See application file for complete search history.

(56) References Cited

U.S. PATENT DOCUMENTS 2,531,116 A * 11/1950 Donoghue ..... 49/23
3,602,786 A * 8/1971 Izhelya et al. ..... 318/135
4,069,616 A 1/1978 Doveinis
4,174,865 A 11/1979 Doveinis
4,689,529 A 8/1987 Higuichi
4,918,835 A * 4/1990 Raschbichler et al. ..... 29/732
5,091,665 A 2/1992 Kelly
5,130,583 A 7/1992 Andoh
5,172,518 A * 12/1992 Yoshino ..... 49/360
5,196,745 A * 3/1993 Trumper ..... 310/12
5,598,044 A 1/1997 Satomi et al.
5,602,431 A 2/1997 Satomi et al.
5,703,417 A 12/1997 Kelly
5,719,451 A 2/1998 Cook et al.
6,415,550 B1 * 7/2002 Fin ..... 49/442
6,430,872 B1 * 8/2002 Fin ..... 49/349
6,476,524 B1 11/2002 Miyamoto et al.
6,570,273 B2 5/2003 Hazelton
6,674,186 B2 1/2004 Yajima et al.
6,756,705 B2 6/2004 Pulford, Jr.
6,876,106 B2 4/2005 Miyashita et al.
6,977,450 B2 12/2005 Asou et al.

FOREIGN PATENT DOCUMENTS

DE 102004037427 A1 * 3/2006
JP 53114111 * 10/1978
JP 2000130021 * 5/2000

OTHER PUBLICATIONS

"Linear Motors Application Guide" of Aerotech, Ltd., Berkshire, United Kingdom, from website: www.Aerotech.com; 15 pages; Undated, downloaded on Mar. 15, 2006.

* cited by examiner

*Primary Examiner*—Jerry Redman

(57) ABSTRACT

A power window system for a motor vehicle operated by a linear electric motor. In one form, a dual linear motor window actuator system includes left and right guidetracks which guide a window, and left and right linear motors connected to the guidetracks. In a second form, a single linear motor window actuator system includes left and right guidetracks which guide a window; a drive bar connected to the window; and a linear motor operatively interconnected with the drive bar. A solenoid operated window stop provides fixed positioning of the window except during actuation of the linear motor.

3 Claims, 6 Drawing Sheets

LINEAR MOTOR-ACTUATED AUTOMOTIVE POWER WINDOWS

TECHNICAL FIELD

The present invention relates to glass windows of motor vehicles capable of moving from a closed position to an open position, and particularly to electrically-powered windows. More particularly, the present invention relates to motor vehicle windows electrically powered by a linear motor.

BACKGROUND OF THE INVENTION

Motor vehicles generally have a number of windows which are capable of moving between a closed, position and an open position (by "open position" is meant as far open as the window is able to go, i.e., fully open). Usually, these movable windows are situated at doors of the motor vehicle. In some instances, the windows are operated by a manual crank handle, but it is becoming ever more common for the windows to be powered electrically. Examples of window regulator mechanisms used in the automotive arts are found in U.S. Pat. Nos. 4,069,616 and 4,174,865.

FIGS. 1A through 2C depict views of two types of prior art electrically-powered window mechanisms in the form of dual and single guiderail systems.

Turning attention firstly to FIGS. 1A and 1B, a prior art dual guiderail electric power-actuated window system 10 is shown located at a door 12 of a motor vehicle. The door 12 has a framework 12*a* to which the dual guiderail electric power-actuated window system 10 is affixed. The dual guiderail electric power-actuated window system 10 includes left and right guiderails 14*a*, 14*b*; a rotary electric motor 16 with an interconnected cable drum 16*a* fixedly attached to one of the guiderails; left and right sliders 18*a*, 18*b* which, respectively, are slidable in relation to the left and right guiderails, wherein each has a respective window clip 20*a*, 20*b*; and a cable system 22 which interfaces by a cable 24 the cable drum with left and right sliders, whereby actuation of the electric motor causes each of the sliders to slide along its respective guiderail so as to cause the window 26 to move between a first, closed position and a second, open position. An upper portion 12*b* of the door frame 12*a* is provided with glass run channels 28, each provided with weather-stripping for guiding the movement of the window 26 (an indication thereof is seen at FIG. 2C).

Turning attention next to FIGS. 2A through 2C, a prior art single guiderail electric power-actuated window system 10' is shown located at a door 12' of a motor vehicle. The door 12' has a framework 12*a'* to which the single guiderail electric power-actuated window system 10' is affixed. The single guiderail electric power-actuated window system 10' includes a guiderail 14'; a rotary electric motor 16' with an interfaced cable drum 16*a'* fixedly attached to the guiderail; a slider 18' which is slidable in relation to the guiderail, wherein a pair of window clips 20*a'*, 20*b'* are attached thereto, one on either side of the guiderail; and a cable system 22' which interfaces by a cable 24' the cable drum with the slider, whereby actuation of the electric motor causes the slider to slide along the guiderail so as to cause the window 26' to move between a first, closed position and a second, open position. An upper portion 12*b'* of the door frame 12*a'* is provided with glass run channels 28' with weather-stripping 30', as shown at FIG. 2C, which extend downwardly into the door interior so as to accommodate the full movement of the window 26' and thereby guidance during movement of the window.

While it is the case that the above-described two types of electrically-powered window systems 10, 10' work well, they involve a considerable number of parts with associated weight, as well as the requirement of a volume of space within the door, which volume is increasingly occupied with components other than those associated with a window system.

Therefore, what is needed is an electric power window actuation system which is a superior alternative to the electric rotary motor-actuated cable systems described above in that it has none of the their detriments.

SUMMARY OF THE INVENTION

The present invention is an electric power window system for a motor vehicle which features window actuation by operation of an electric linear motor, or linear actuator, rather than a rotary electric motor as is practiced in the prior art.

According to a first embodiment of the present invention, a dual linear motor window actuator system includes: left and right guidetracks which guidably interface with respective left and right sides of a window; and left and right linear motors, wherein the stators of the linear motors are fixed in relation to the guidetracks (by being connected to the guidetracks and/or the door frame of the subject motor vehicle), and wherein the armatures of the linear motors are situated, respectively, at the left and rights sides of the window.

According to a second embodiment of the present invention, a single linear motor window actuator system includes: left and right guidetracks which guidably interface with respective left and right sides of a window; a drive bar which is connected to the bottom of a window; and a linear motor, wherein the armature of the linear motor is carried on the drive bar, and wherein the stator of the linear motor is in fixed position with respect to the guidetracks (as, for example, by being connected to the door frame of the subject motor vehicle).

In both the first and second embodiments, a solenoid-operated window stop provides fixed positioning of the window except during actuation of the linear motors.

Accordingly, it is an object of the present invention to provide an electric power window for a motor vehicle which is actuated by a linear motor.

This and additional objects, features and advantages of the present invention will become clearer from the following specification of a preferred embodiment.

BRIEF DESCRIPTION OF THE DRAWINGS

FIGS. 3A and 3B are schematic views of a first embodiment of the present invention, wherein FIG. 3A shows a window at its first, closed position and FIG. 3B shows the window at its second, open position.

FIGS. 4A and 4B are schematic views of a second embodiment of the present invention, wherein FIG. 4A shows a window at its first, closed position and FIG. 4B shows the window at its second, open position.

FIGS. 7A and 7B are schematic views of a solenoid-operated window stop of the first embodiment of the present invention, wherein FIG. 7A shows the window stop inactive and FIG. 7B shows the window stop active.

FIGS. 8A and 8B are schematic views of a solenoid-operated window stop of the second embodiment of the present invention, wherein FIG. 8A shows the window stop inactive and FIG. 8B shows the window stop active.

DESCRIPTION OF THE PREFERRED EMBODIMENT

Figure 1A:
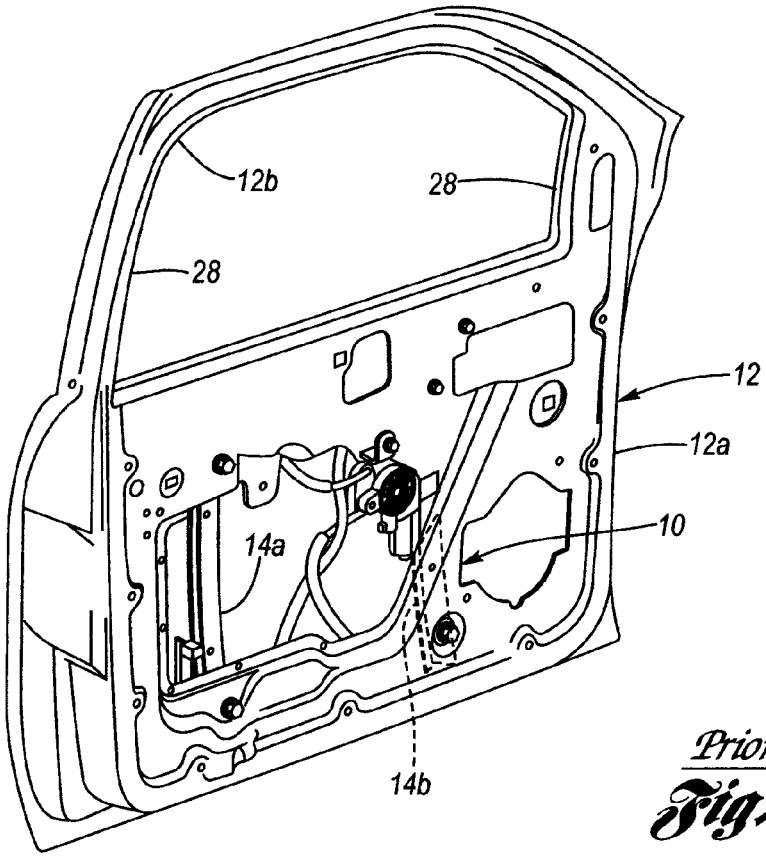
Prior Art Fig. 1A
FIGS. 1A and 1B are perspective views of a prior art dual guiderail electric power-actuated window system.
Figure 1B:
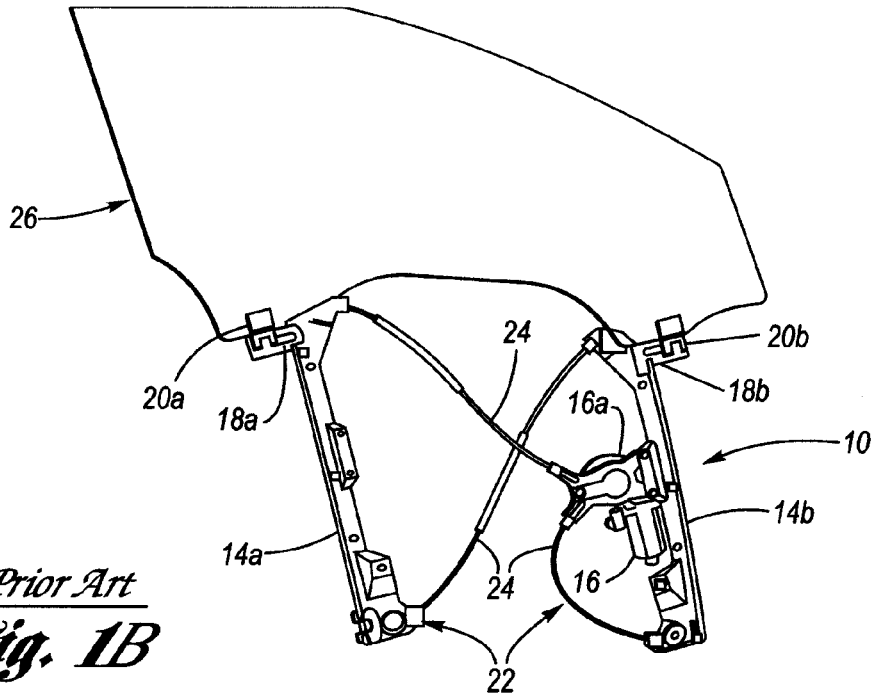
Prior Art Fig. 1B
Figure 2A:
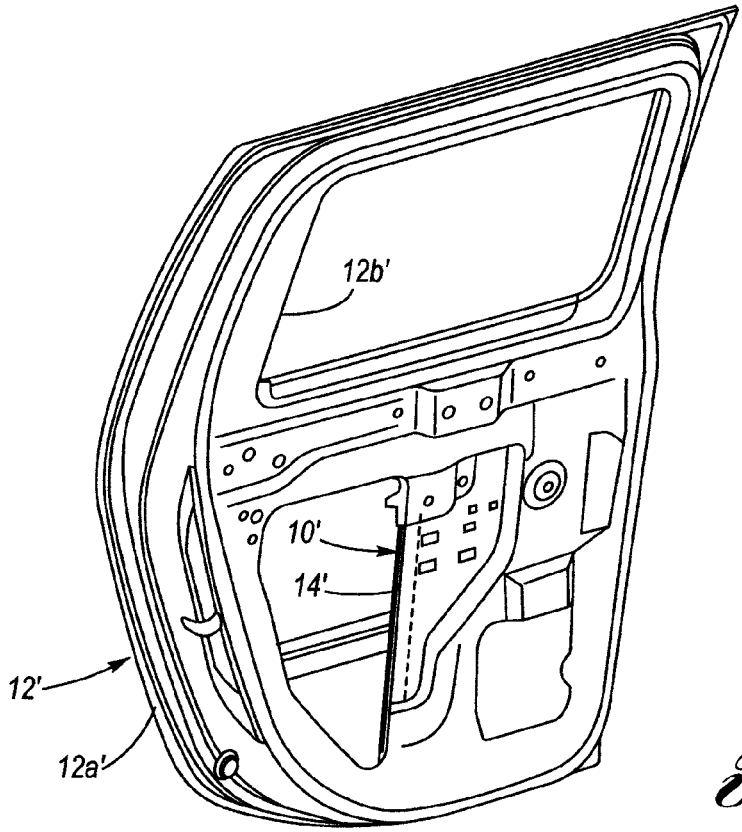
Prior Art Fig. 2A
FIGS. 2A and 2B are perspective views of a prior art single guiderail electric power-actuated window system.
Figure 2C:
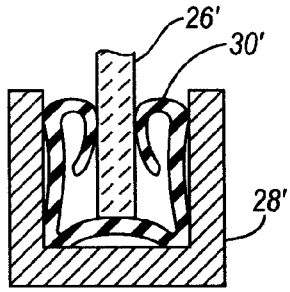
Prior Art Fig. 2C
FIG. 2C is a sectional view seen along line 2C-2C of FIG. 2B.
Figure 2B:
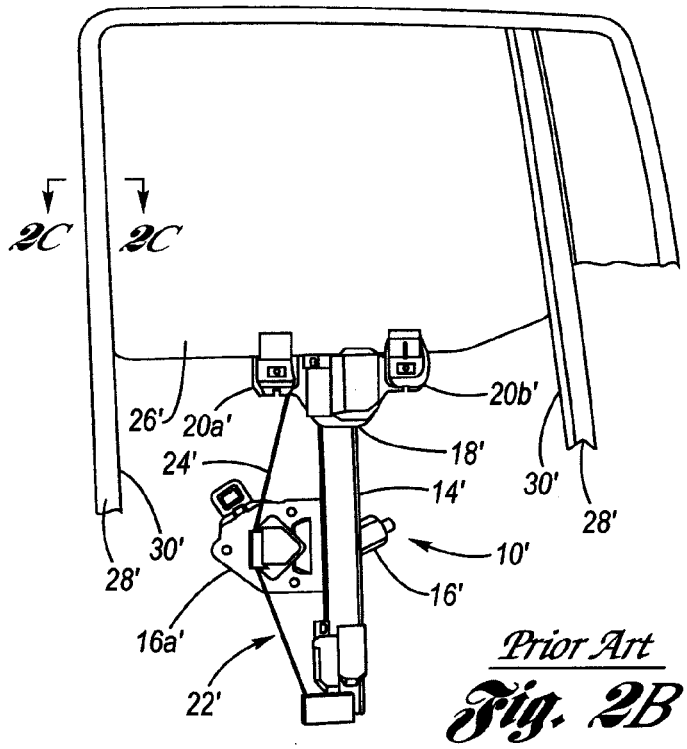
Prior Art Fig. 2B

Referring now to the Drawing, FIGS. 3 through 9B depict various aspects of electric power window systems for a motor vehicle which feature linear motor window actuation according to the present invention. Herein, it is to be understood that the embodiments shown and described are illustrative examples, and are not intended to limit the scope of the present invention, the scope being defined only by the appended claims.

Figure 3A:
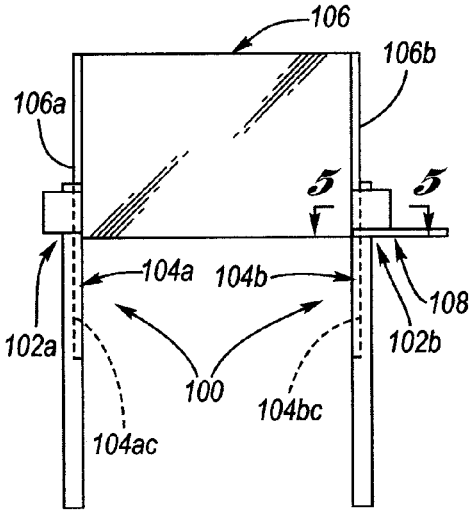
Figure 3B:
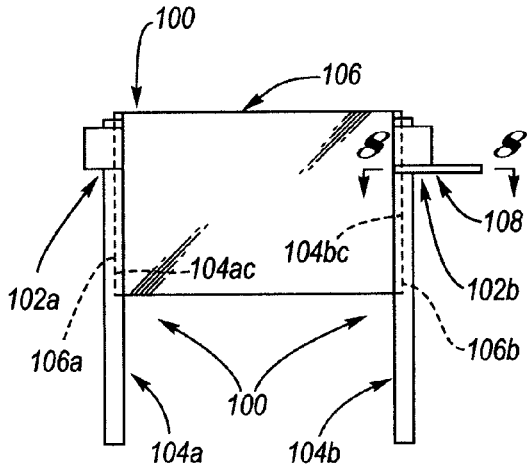

FIGS. 3A, 3B, 5, 7A and 7B are all related to a first embodiment of a linear motor window actuator system 100 featuring left and right linear motors 102*a*, 102*b*. As seen at FIGS. 3A and 3B, the linear motor window actuator system 100 includes: left and right guidetracks 104*a*, 104*b* which are configured to guidably interface with respective left and right sides 106*a*, 106*b* of a window 106; the above-mentioned left and right linear motors 102*a*, 102*b*; and a window stop mechanism 108. The window 106 is movable between a first, closed position and a second open position and anywhere in between by operation of the linear motors 102*a*, 102*b* and the permission of the window stop mechanism 108. The left and right guidetracks 104*a*, 104*b* each have a run channel 104*ac*, 104*bc* which includes weather stripping as generally described hereinabove, which may preferably include the linear motors.

Figure 5:
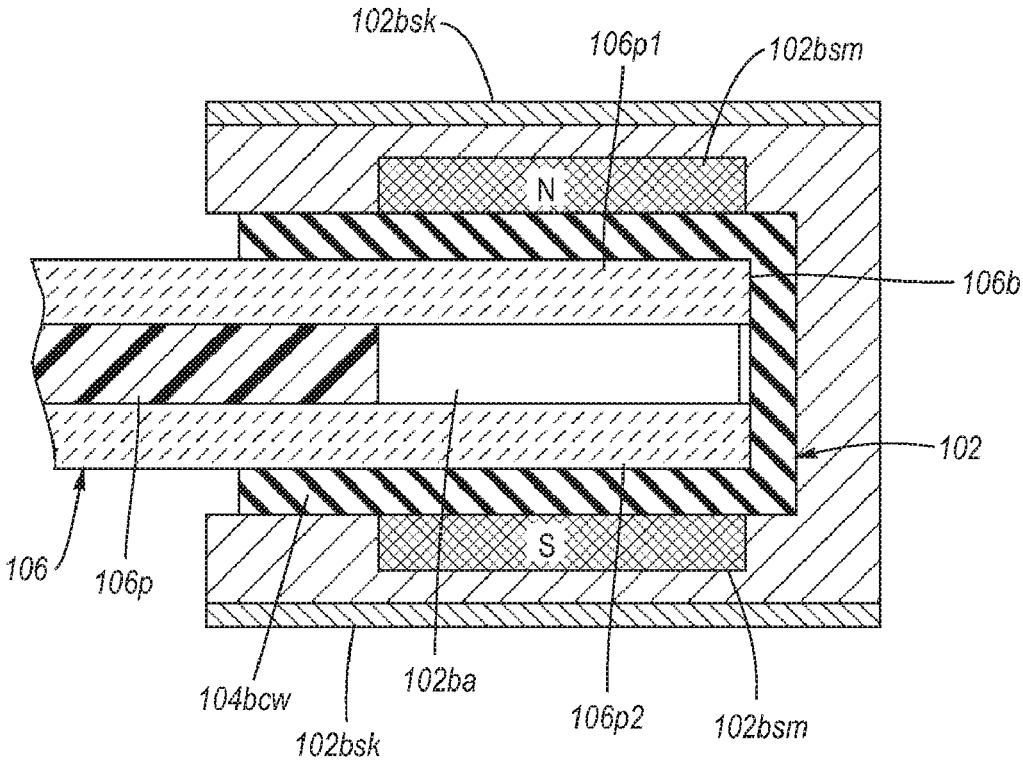
FIG. 5 is a sectional view along line 5-5 of FIG. 3A showing a cross-section of a linear motor of the first embodiment of the present invention.

Referring to FIG. 5, an exemplar view of the interface between each linear motor and the window is shown by way of example with respect to the right linear motor 102*b* and the right side 106*b* of the window 106. In this regard, the window 106 is a laminate with two outer glass panes 106*p*1 and 106*p*2 which sandwich therebetween a plastic layer 106*p*. At the right window side 106*b* the armature 102*ba* having therewithin drive coils (not shown, but see FIGS. 9A and 9B) of the right linear motor 102*b* is affixed stationarily in the window between the outer panes 106*p*1, 106*p*2. The stator 102*bs* of the right linear motor 102*b* includes stator permanent magnets 102*bsm* and magnetic field keepers 102*bsk* and is affixed stationarily to the right guidetrack 104*b*. Weather-stripping 104*bcw* of the run channel 104*bc* may be located at the linear motor 102*b*, provided it does not create too much air gap for the linear motor (if it does create an undesirable air gap, then the weather-stripping is not present at the linear motor). It is to be understood the left linear motor 102*a* is interfaced with the left side 106*a* of the window 106 and the right guidetrack 104*a* in the same manner.

Figure 7A:
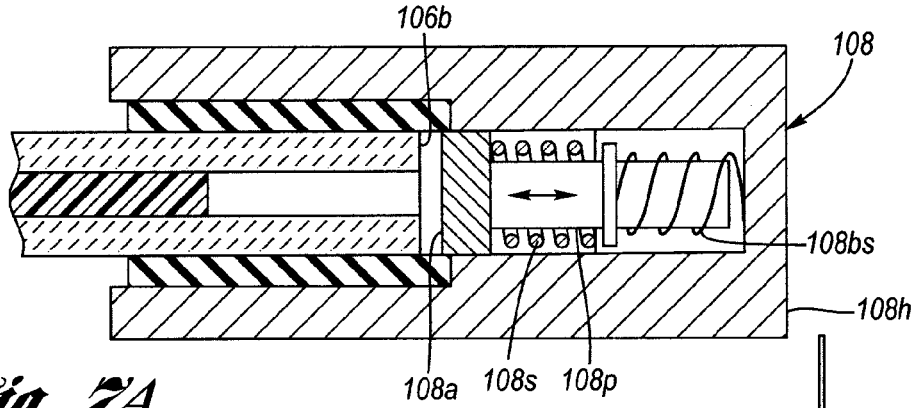
Figure 7B:
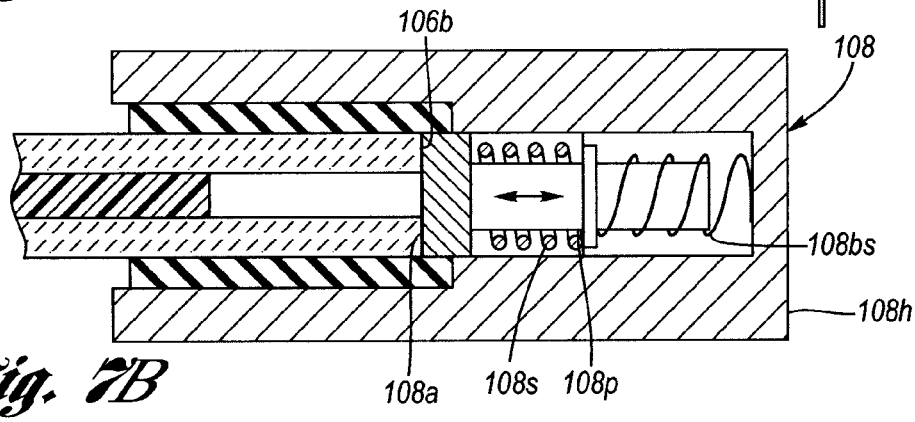

Referring now to FIGS. 7A and 7B, an exemplar view of the window stop mechanism 108 is shown situated at the right side 106*b* of the window 106; it is to be understood there may be a second window stop mechanism at the left side of the window, as well. The window stop mechanism 108 includes a housing 108*h* which is fixedly connected to (or integral with) the left guidetrack 104*b*. Within the housing 108*h* is a solenoid 108*s* which engirds a magnetic piston 108*p* having a head 108*a* which is normally biased toward the right side 106*b* of the window 106 by a biasing spring 108*bs*. When the solenoid 108*s* is not energized, the head biases frictionally against the side of the window, preventing the window from moving between its first and second positions; however, when the solenoid is energized, the piston moves away from the window, against the biasing of the biasing spring, whereupon the window is free to move between its first and second positions in relation thereto.

In operation, when a motor vehicle occupant wishes to move a particular window to be open or closed, or more or less open or closed, a conventional window switch is pressed. The pressing of the switch results first in the solenoid 108*s* being energized, whereupon the head 108*a* is moved from frictional engagement with the window 106. Now, the left and right linear motors 102*a*, 102*b* are actuated, causing the window to move as the occupant desires. As soon as the window movement ceases and the linear motors are deactivated, the energization of the solenoid ceases, whereupon the head frictionally engages the window so that the window is stably held in the position dictated by the occupant.

Figure 4A:
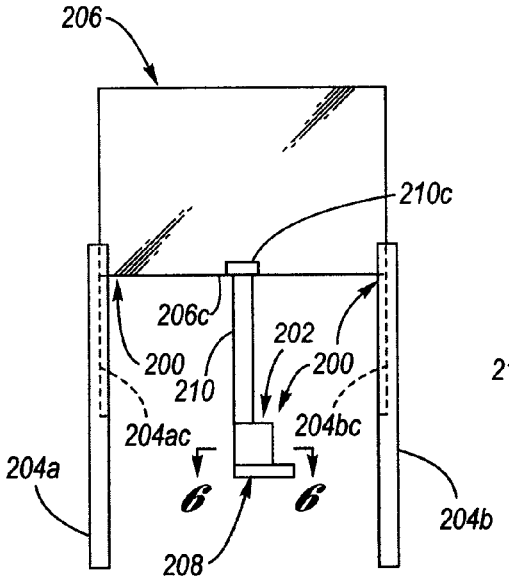
Figure 4B:
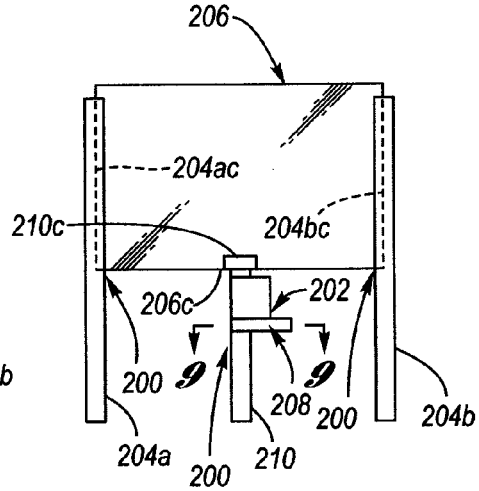

FIGS. 4A, 4B, 6, 8A, and 8B are all related to a second embodiment of a linear motor window actuator system 200 featuring a single motor 202. As seen at FIGS. 4A and 4B, the linear motor window actuator system 200 includes: left and right guidetracks 204*a*, 204*b* which are configured to guidably interface with respective left and right sides 206*a*, 206*b* of a window 206; a drive bar 210 connected to the bottom 206*c* of the window via a clip 210*c*; the above-mentioned linear motor 202; and a window stop mechanism 208. The window 206 is movable between a first closed position and a second, open position and anywhere in between by operation of the linear motor 202 and the permission of the window stop mechanism 208. The left and right guidetracks 204*a*, 204*b* each have a run channel 204*ac*, 204*bc* which includes weather-stripping as generally described hereinabove.

Figure 6:
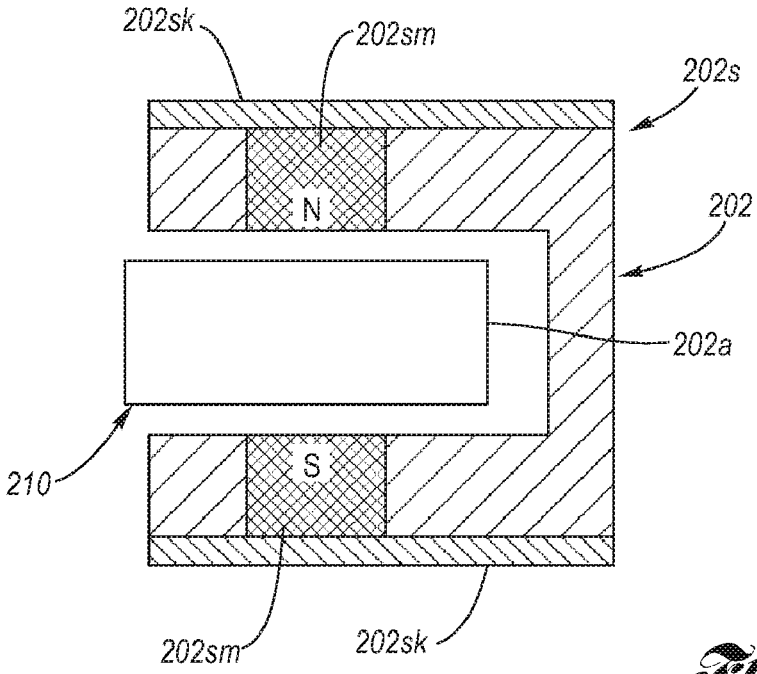
FIG. 6 is a sectional view along line 6-6 of FIG. 4A showing a cross-section of the linear motor of the second embodiment of the present invention.

Referring to FIG. 6, an exemplar view of the interface between the linear motor 202 and the drive bar 210 is shown by way of example. The armature 202*a* of the linear motor 202 has therewithin drive coils (not shown, but see FIGS. 9A and 9B) and is affixed stationarily to the drive bar 210. The stator 202*s* of the linear motor 202 includes stator permanent magnets 202*sm* and magnetic field keepers 202*sk* and is affixed stationarily with respect to the left and right guide guidetracks 204*a*, 204*b*, which may be by all of these components being stationarily affixed to a door frame of a motor vehicle.

Figure 8A:
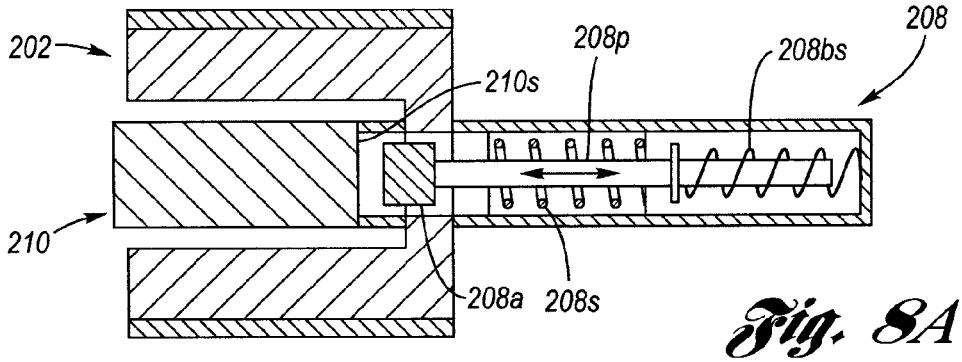
Figure 8B:
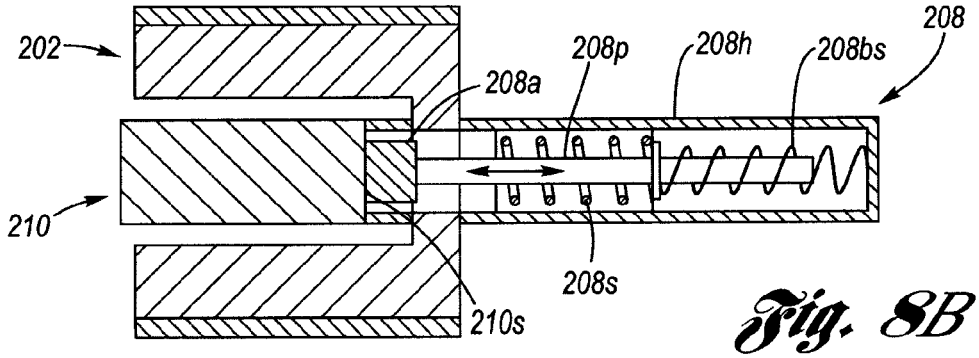

Referring now to FIGS. 8A and 8B, an exemplar view of the window stop mechanism 208 is shown situated at drive bar 210. The window stop mechanism 208 includes a housing 208*h* which is fixedly connected to (or integral with) the drive bar 210. Within the housing 208*h* is a solenoid 208*s* which engirds a magnetic piston 208*p* having a head 208*a* which is normally biased toward the drive bar 210 by a biasing spring 208*bs*. When the solenoid 208*s* is not energized, the head biases frictionally against the side 210*s* of the drive bar, preventing the window from moving between its first and second positions; however, when the solenoid is energized, the piston moves away from the drive bar, against the biasing of the biasing spring, whereupon the window is free to move between its first and second positions in relation thereto.

In operation, when a motor vehicle occupant wishes to move a particular window closed or open, or more or less open or closed, a conventional window switch is pressed. The pressing of the switch results first in the solenoid 208*s* being energized, whereupon the head 208*s* is moved from frictional engagement with the drive bar 210. Now, the linear motor 202 is actuated causing the window to move as the occupant desires. As soon as the window movement ceases and the linear motor is deactivated, the energization of the solenoid ceases, whereupon the head frictionally engages the drive bar so that the window is stably held in the position dictated by the occupant.

In the prior art, electric linear motors (sometimes referred to as linear actuators) are well known, as exemplified by U.S. Pat. Nos. 4,689,529; 5,091,665; 5,130,583; 5,598,044; 5,602,431; 5,719,451; 6,476,524; 6,570,273; 6,674,186; 6,756,705; 6,876,106; and 6,977,450.

Of particular interest are U.S. Pat. No. 6,570,273 to Hazelton, issued on May 27, 2003; U.S. Pat. No. 5,130,583 to Andoh, issued on Jul. 14, 1992; and, U.S. Pat. No. 5,703,417 issued on Dec. 30, 1997 to Kelly, the disclosure of each of which is hereby herein incorporated by reference, wherein the linear motor described therein may be readily adapted by those having ordinary skill in the art to the present invention using as a guide the disclosure of the present invention detailed hereinabove.

Figure 9A:
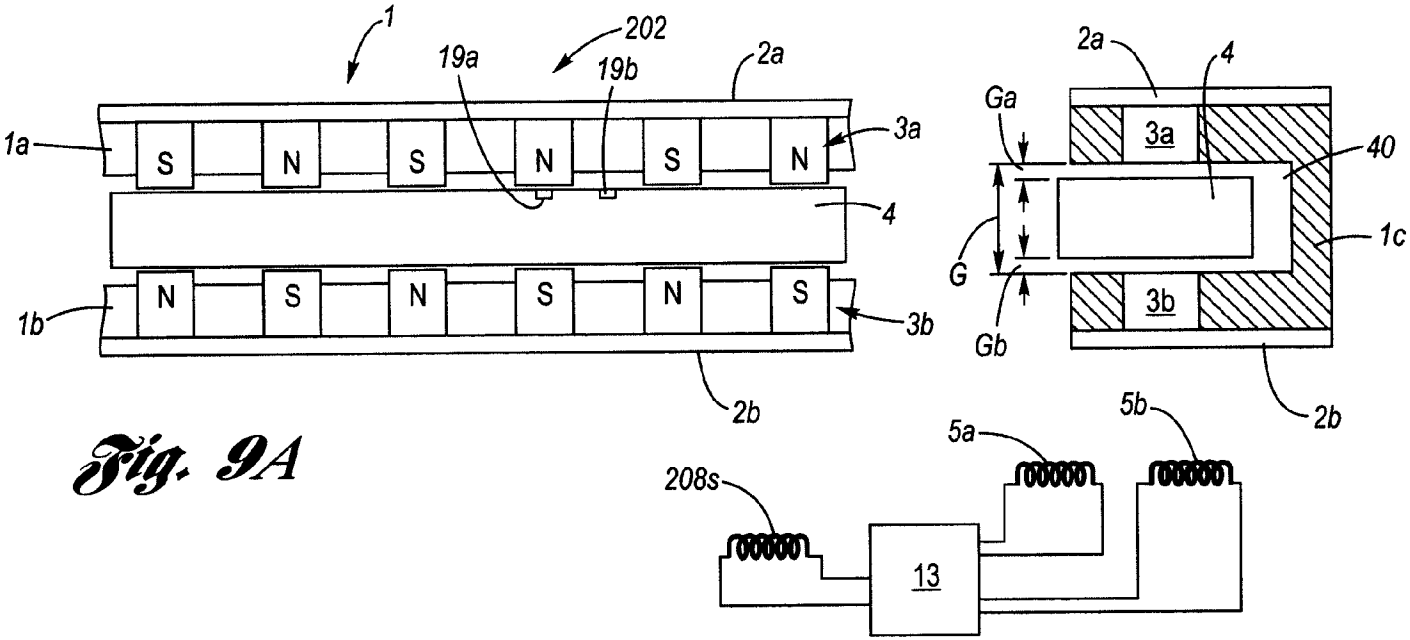
FIGS. 9A and 9B illustrate aspects of a linear motor suitable for the first and second embodiments of the present invention, being particularly described with respect to the second embodiment of the present invention.
Figure 9B:
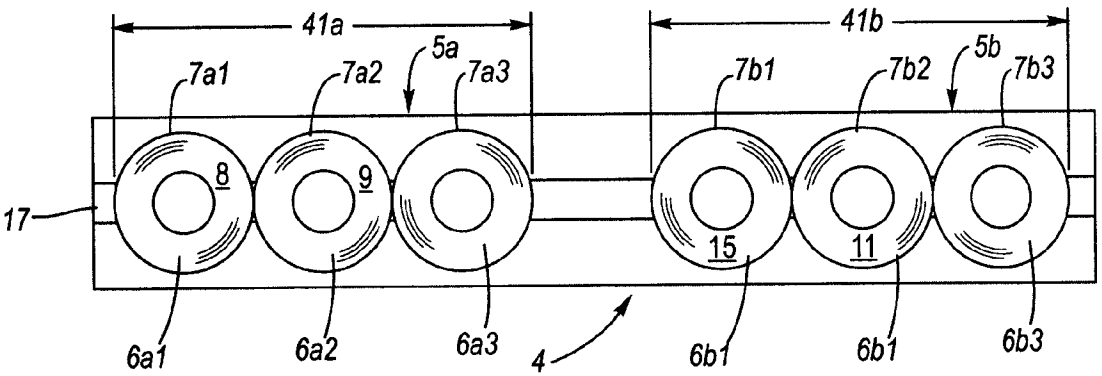

Referring now to FIGS. 9A and 9B, the specifics of a linear motor will be discussed with regard to the disclosure of previously herein incorporated U.S. Pat. No. 5,703,417 and the linear motor 202 of FIG. 6.

FIG. 9A shows the stator of the motor comprises two elongate rectangular bars 1*a*, 1*b* of a non-ferromagnetic material extending over the length of the motor and which are held parallel to one another by rigid spacing posts or webs (not shown) or alternatively by an elongate plate extending parallel to the plane of the figure at one lateral edge of the bars 1*a*, 1*b*. Affixed to the outside of each elongate bar are ferromagnetic keepers 2*a* and 2*b*, preferably comprising soft iron strips.

The stator 1 of the linear motor 202 is provided with a set of magnetic flux generators comprising opposed pairs 3*a*, 3*b* of cylindrical permanent magnets rigidly secured within the bars 1*a*, 1*b*, e.g., by adhesive. The polarities of successive pairs of the magnets 3*a*, 3*b* alternate along the length of the motor as illustrated. This alternation means that an adjacent pair of the magnets 3*a* or 3*b* are connected magnetically by the intervening length of the keepers 2*a* or 2*b* and form a "horseshoe" magnet so that the magnetic flux is concentrated into the gap between magnet 3*a* and the opposed, paired magnet 3*b*. A consequence of this is that there is relatively little magnetic leakage flux produced in the region to the other side of the keeper, i.e., above the keeper 2*a* and below the keeper 2*b* in FIG. 9A, as well as relatively little leakage between adjacent sides of the magnets. It is an important advantage that the magnets can each be spaced from the next, rather than virtually abutting one another. This arises because they are only required to create fields cutting the coils themselves, at their sides. This provides a significant saving in magnetic material and therefore cost in comparison with prior art motors utilizing rectangular magnets.

It will be noted from FIG. 9A that the opposed faces of the magnet pairs 3*a*, 3*b* define a stator magnetic circuit air gap G extending across the width (i.e., the height in FIG. 9A) of the channel 40 defined between the bars 1*a* and 1*b*. Both this stator air gap G and the channel 40 extend over the length of relative movement of the armature and stator of the motor. Where the armature occupies the channel 40, minimal residual air gaps Ga and Gb are left between the inner faces of the bars 1*a* and 1*b* and the lateral faces of the armature 4.

In one arrangement, the pole pitch of the magnets is substantially twice their diameter and each magnet has a length substantially equal to half its diameter. The magnets 3*a*, 3*b* of each pair are axially aligned and their opposed faces are spaced apart by a distance comparable with their lengths, leaving the longitudinal gap G through which the armature 4 extends and travels.

The stator 1 can be of any arbitrary length. To enhance its rigidity, the elongate bars thereof 1*a*, 1*b* may form part of an aluminium extrusion as shown at 1*c*. It will be appreciated that in this form of the stator, the extrusion 1*c* can be cut, in between magnets, to provide close to any desired length of stator.

The armature 4 is shown to an enlarged scale in FIG. 9B. It can be in the form of an elongate rectangular metal, e.g., aluminium, bar and carries two coils 5*a* and 5*b*.

Each of the coils 5*a*, 5*b* comprises two or more sub-coils 6*a*1, 6*a*2, 6*a*3 and 6*b*1, 6*b*2, 6*b*3. These coils are secured in respective apertures 7*a*1, 7*a*2, 7*a*3 and 7*b*1, 7*b*2, 7*b*3 extending through the stator 4. Within each group of sub-coils, the apertures 7*a*1, 7*a*2, 7*a*3 and 7*b*1, 7*b*2, 7*b*3, and consequently the sub-coils 6*a*1, 6*a*2, 6*a*3 and 6*b*1, 6*b*2, 6*b*3 which they accommodate are spaced apart longitudinally by a distance substantially equal to the longitudinal pole pitch of the magnets 3*a*, 3*b* on the stator 1. Furthermore, the sub-coils of the two coils are longitudinally offset by half the magnet 3*a*, 3*b* pole pitch. In general, there may be N such coils and it will be appreciated, therefore, that in the general case, the longitudinal offset between the sub-cells of the N coils should be 1/N of the pole pitch.

It will be noted from FIG. 9B that the longitudinal regions 4*a* and 4*b* occupied respectively by the sub-coils of drive coils 6*a* and 6*b* do not overlap so that each sub-coil can fill substantially the entire width of the air gap G (apart from the residual air gaps Ga and Gb). In other words, there is no point at which windings of the sub-coils of different ones of the drive coils are located in the same lateral extent of the air gap G.

In keeping with the concept that the motor should have as much coil conductor material (copper) per unit length of the motor, within each coil, the sub-coils are arranged such that longitudinally adjacent ones of them substantially abut one another at their peripheries, i.e., the spacing between their peripheries is negligible compared with their diameters.

The sub-coils of each coil are arranged such that in the portions of their windings which are adjacent one another as at the regions 8 and 9 and 15 and 11 the currents passing through those winding portions produce magnetic fields of the same polarity. This is fundamental in maximizing the amount of thrust which the linear motor 202 can generate. The production of fields of the same polarity of these portions can be achieved either by alternating the winding sense of the coils or by suitable selection of the polarity of the electrical connections between them or of the polarity of the drive currents applied to them.

The axial extent of each of the sub-coils is substantially equal to the thickness of the armature 4 and is arranged to minimise the air gap. It will be noted from FIG. 9B that the central region of each major face of the armature 4 can be machined to provide a shallow channel 17 to accommodate leads and connections to the coils.

The armature coils 5*a*, 5*b* and the solenoid 208*s* are energized by a controller and commutator circuit 13 in FIG. 9A, which first actuates the solenoid, and processes the output of Hall effect magnetic field strength detectors 19*a*, 19*b* or optical encoder information (in a known manner) to determine the longitudinal position of the armature relative to the stator and responds to control signals to provide closed loop servo control of the position of the armature relative to the stator. The controller can further provide for the armature to be energized in a manner to follow a desired velocity profile when moving between the first and second positions of the window.

In this embodiment, the coils 5*a*, 5*b* (and their sub-coils 6*a*1, 6*a*2, 6*a*3) are in separate longitudinally spaced regions of the armature, and they can be arranged side by side (laterally of the motor) so that they overlap longitudinally of the motor without windings of different drive coils needing to coexist (i.e., to overlap) in the same lateral extent of the air gap G.

Movement of the coils along the magnets of the stator is achieved by energising the coils in a sequence (see U.S. Pat. No. 5,703,417). Currents are supplied in sequence to cause each coil to try to move to a position of least magnetic salience relative to the fields passing between the magnet faces. The position of least salience is when each sub-coil is oriented directly over a pair of facing magnets.

To those skilled in the art to which this invention appertains, the above described preferred embodiment may be subject to change or modification. For example the linear motors used in the present invention may have the permanent magnets disposed in either the stator or the armature and the coils disposed in the other of the stator and armature, as for example described in incorporated by reference U.S. Pat. No. 5,130,583 (i.e., see FIG. 4 versus FIG. 14). Further for example, while the present invention shows various views of windows moving vertically between a first, closed position that is "up" and a second, closed position that is "down", the present invention is intended to be implemented independently of orientation, i.e., the window may move horizontally, wherein the first and second positions are horizonally separated, as for example a pick-up truck rear window that is power slidable horizontally. Such change or modification can be carried out without departing from the scope of the invention, which is intended to be limited only by the scope of the appended claims.

The invention claimed is:

1. An electrically actuated power window system for a motor vehicle, comprising:

a window having a left window side and a right window side;

a right window guidance member having a right run channel for guiding said right side of said window during movement of said window between a first position and a second position;

a left window guidance member having a left run channel for guiding said left side of said window during movement of said window between said first position and said second position;

at least one linear motor connected with said window, wherein selective actuation of said at least one linear motor causes selective movement of said window between said first position and said second position; and an electrically operated window stop, wherein said window stop is configured to biasably extend when not electrically actuated so as to thereby prevent movement of the window and to retract against the biasing when electrically actuated; wherein said window stop is electrically actuated whenever said window moves in response to actuation of said at least one linear motor;

wherein said at least one linear motor comprises:

a right linear motor integrated with said right window guidance member at said right run channel thereof, a right armature of said right linear motor being disposed in said right side of said window; and a left linear motor integrated with said left window guidance member at said left run channel thereof, a left armature of said left linear motor being disposed in said left side of said window.

2. The power window system of claim 1, further comprising:

a right stator of said right linear motor disposed in said right window guidance member, wherein weather stripping is disposed in said right run channel generally between said right stator and said right armature; and a left stator of said left linear motor disposed in said left window guidance member, wherein weather stripping is disposed in said left run channel generally between said left stator and said left armature.

3. An electrically actuated power window system for a motor vehicle, comprising:

a window having a left window side and a right window side;

a right window guidance member having a right run channel which guides said right side of said window during movement of said window between a first position and a second position;

a left window guidance member having a left run channel which guides said left side of said window during movement of said window between a first position and a second position;

a drive bar connected to said window;

at least one linear motor connected with said drive bar, wherein selective actuation of the at least one linear motor causes selective movement of said window between said first position and said second position; and an electrically operated window stop, wherein said window stop is configured to biasably extend when not electrically actuated so as to thereby prevent movement of the window and to retract against the biasing when electrically actuated; wherein said window stop is electrically actuated whenever said window moves in response to actuation of said at least one linear motor.

* * * * *